United States Patent [19]

Edwards et al.

[11] 4,212,549

[45] Jul. 15, 1980

[54] DISC PRINTER

[75] Inventors: Albert L. Edwards, Thousand Oaks; Aram S. Arzoumanian, Encino, both of Calif.

[73] Assignee: Dataproducts Corporation, Woodland Hills, Calif.

[21] Appl. No.: 939,328

[22] Filed: Sep. 5, 1978

[51] Int. Cl.[2] ..... B41J 1/26

[52] U.S. Cl. ..... 400/154; 101/93.08; 101/93.19; 400/104

[58] Field of Search ..... 101/93.08, 93.19; 400/104, 105, 152, 154, 154.1, 154.4, 155, 156, 157, 188–190

[56] References Cited

U.S. PATENT DOCUMENTS

| | | | |
|---|---|---|---|
| 3,669,237 | 6/1972 | Wagner et al. | 101/93.19 X |
| 3,687,071 | 8/1972 | Kling | 101/93.19 |
| 3,896,919 | 7/1975 | Hutley | 400/157 |

*Primary Examiner*—Paul T. Sewell

[57] ABSTRACT

This disc printer uses a relatively massive, rigid print disc having a flat face on which two sets of raised character fonts are arranged in separate spirals. Advantageously, the inner font set contains machine readable characters which are printable with high resolution, and a second font set arranged so that the characters are upright as they pass a print zone which is vertically offset from the zone in which the high resolution characters are printed. The print disc acts as the platen for printing. With this arrangement, the same print disc can be used to print characters onto a record medium at two different elevations, while maintaining the medium flat, and without the need to transport the medium vertically. A check printer also is disclosed which uses the print disc to print machine readable, high resolution characters onto the check during linear transport of the check in one direction, and to print other indicia onto the check during linear transport thereof in either the same or the opposite direction.

12 Claims, 9 Drawing Figures

Fig. 3A
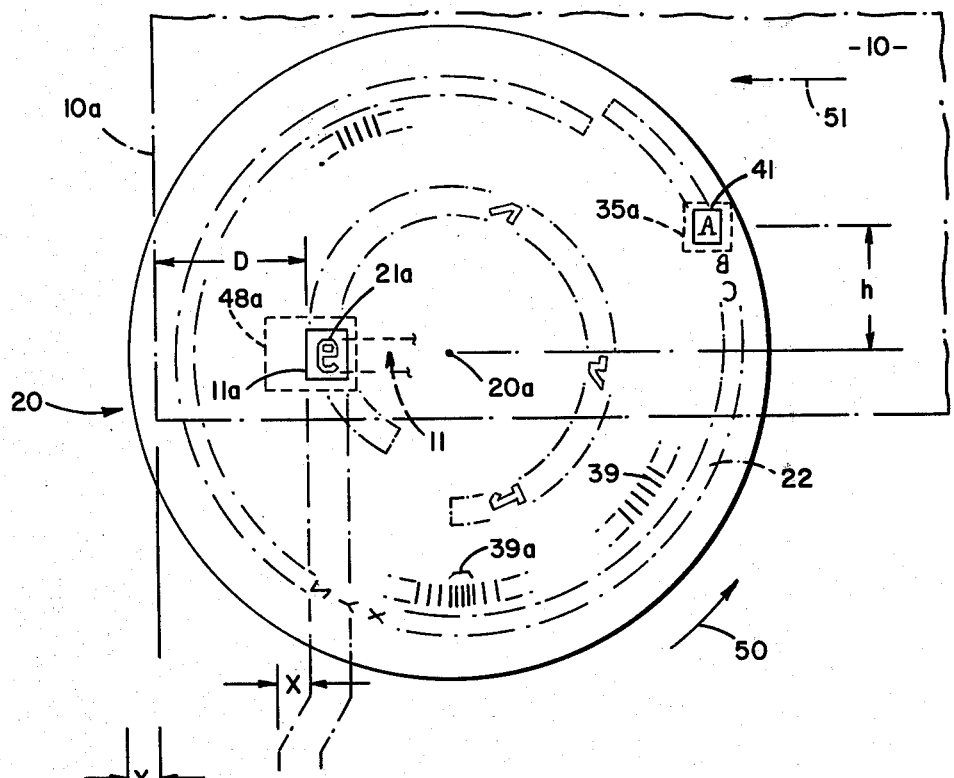
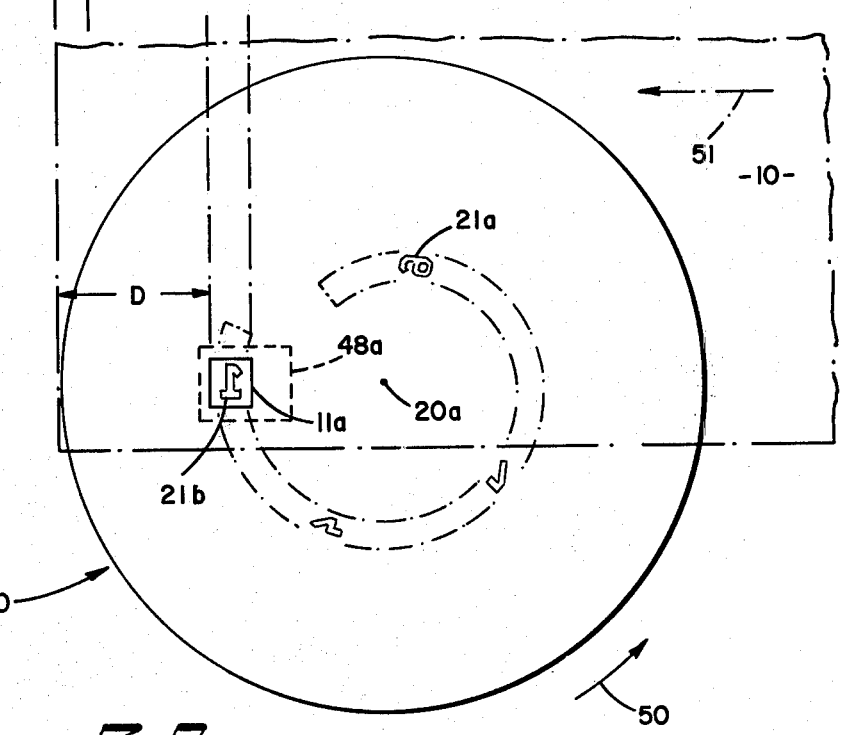
Fig. 3B

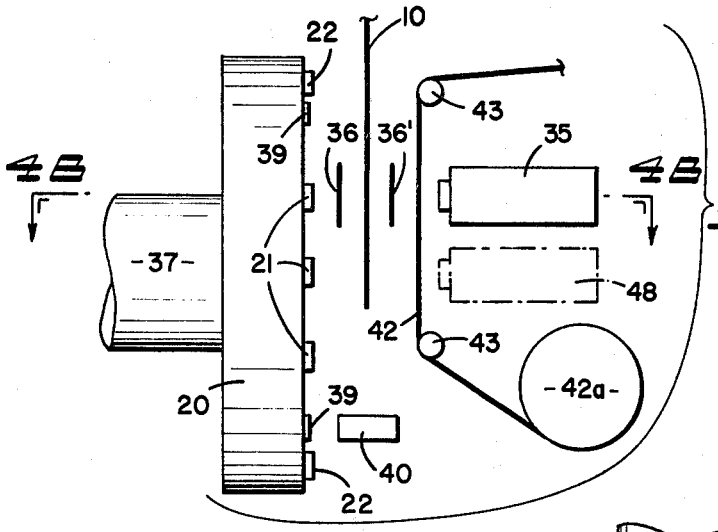
Fig. 4A
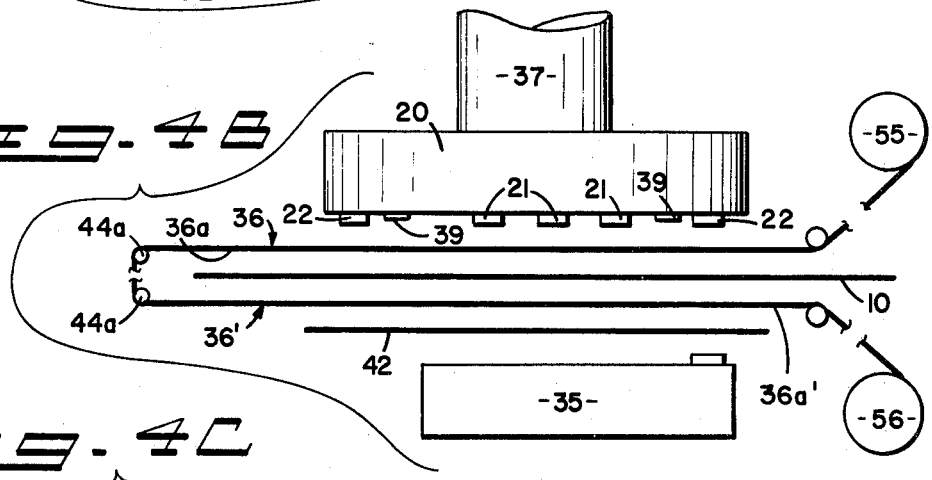
Fig. 4B
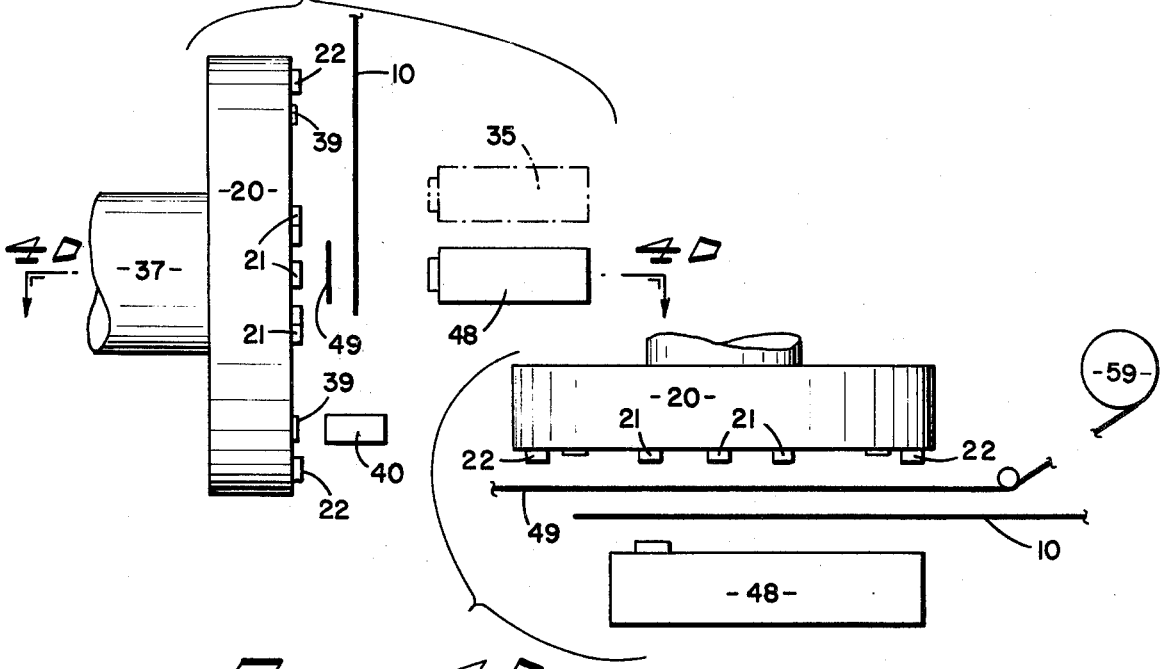
Fig. 4C
Fig. 4D

DISC PRINTER

BACKGROUND OF THE INVENTION

1. Field of the Invention

The present invention relates to a disc printer, and particularly to a printer in which raised type fonts are integrally formed on the front face of a relatively massive disc that serves as a platen during printing. The invention also relates to an apparatus using this disc printer to imprint machine readable numerals and other indicia onto a bank check.

2. Description of the Prior Art

In the processing of conventional bank checks, it is desirable to print onto the check in machine readable form the amount for which the check has been made out. For example, the check 10 in FIG. 1 has been made out in the amount of $60.00. During bank processing, this numerical amount (i.e., "60.00") advantageously is printed in machine readable figures in the lower right hand corner 11 of the check. One object of the present invention is to provide an apparatus for accomplishing such check printing.

Generally this printing is done as part of the processing when the check reaches the drawee bank. Another object of the present invention is to provide an apparatus for facilitating such processing. To this end, the apparatus first reads the information which is preprinted at the bottom 12 of the check in machine readable type. Usually this data includes the drawee bank identification number and the drawer's checking account number. This data enables interrogation of the bank's bookkeeping computer to determine if sufficient funds are present in the identified account to cover the check, the amount of which may be read by an operator from the region 13 of the check, and entered into the computer via a keyboard. If sufficient funds are present, the apparatus then prints the amount of the check in machine readable figures, in the region 11, for future processing.

Concurrent with these operations, the apparatus also prints additional information concerning the transaction in a region 14 of the check and on the back of the check simultaneously. This may include an identification of the particular bank branch at which the check is processed, the date of processing, a transaction number and optionally, the amount of the check. This printing need not be in machine readable format, since it is not required for automatic processing of the check. However, it is desirable that the same information be duplicated onto a roll of paper or other form of ledger to provide a positive written record of the transaction. A further object of the present invention is to provide a check processing apparatus which performs such duplicate printing.

The foregoing description indicates the desirability of providing a printer which is capable of printing both high resolution, machine readable numerals (in the zone 11), and of printing conventional alphanumric characters (in the region 14) without the need for high resolution. A further object of the present invention is to provide such a printer, and specifically to provide a single disc printer capable of such dual printing operation.

As can be seen from FIG. 1, the vertical position or elevation of the printing region 14 is higher than that of the numerical printing region 11. To accomplish such printing at two elevations requires either that the check be transported vertically, or that the printer be capable of printing at two different elevations while the check remains in a fixed vertical position. The latter arrangement is preferred, since it considerably simplifies the requirements for transporting the check through the printing apparatus. Another object of the present invention is to accomplish such printing at dual elevations without requiring vertical movement of the check.

While printers are available which are capable of simultaneously printing plural characters in the same row, these are far more expensive than devices in which characters are printed one at a time, and in which there is relative horizontal movement between the print head and the medium which is being printed. An object of the present invention is to provide a check printer of the latter type, in which the check is transported horizontally past a single print disc. A further objective is to provide a single print disc which itself facilitates printing at two different elevations, and which also serves as the platen for such printing.

The use of a flat platen eliminates the need to curl the check about a cylindrical or other curved platen surface, thereby simplifying the mechanical arrangement for handling the check during printing. A further object of the present invention is to use a relatively massive print disc to function both as a flat platen and as the printhead itself.

To this end, the face of the print disc contains raised type fonts arranged in a spiral or flat helix. The spiral arrangement has the benefit of permitting printing to be accomplished onto a check while it is being linearly moved past the print disc at a uniform rate.

The use of type fonts arranged in a spiral on a rotating type disc is shown in the U.S. Pat. No. 3,356,199 to Robinson. In that printer, the type disc consists of a plurality of resilient, flexible spokes radiating from a common hub. A single raised type font is formed at the end of each spoke. To accomplish printing, a hammer impacts an individual spoke, and flexes that spoke toward a stationary platen. An ink ribbon and paper are disposed between the flexible spokes and the platen, so that as the spoke is impacted and flexed, the type font on the spoke strikes the ribbon against the paper and platen to accomplish printing.

In the Robinson apparatus, the rotating print disc and its associated hammer together are continuously transported in a horizontal direction along the line of printing. The spiral type arrangement ensures that for a particular print position, the printed character will be centered despite the fact that the print wheel is being transported linearly during the printing operation. The pitch of the spiral compensates for the linear translation.

Rotating print discs having type elements at the end of flexible, radial spokes also are shown in the U.S. Pat. No. 3,651,915 Folkens, No. 3,915,279 to Schacht, No. 3,924,725 to Kuhn et al, and No. 3,954,163 to Gabor. This type of spoked print disc is disadvantageous in that it requires a separate platen. If printing at two vertical elevations is required, as in a check printer of the type described, the use of a flexible spoked print disc would severely complicate the required mechanism.

In the Robinson printer (U.S. Pat. No. 3,356,199), a spiral type arrangement is used to compensate for linear movement of the rotating print disc and its associated hammer. The U.S. Pat. No. 2,071,406 to Jerome also shows raised type fonts arranged in a spiral on a printing disc. That disc, however, is part of a weight indicating and printing mechanism. The shaft of the disc is mounted to the lever arm of a scale. With increasing weight, this lever arm is further displaced in a vertical direction. The spiral type arrangement compensates for this vertical shaft movement and permits printing in a fixed vertical plane. Thus the Jerome mechanism, like that of Robinson, uses a spiral type arrangement to compensate for linear movement of the print disc itself. By contradistinction, it is an objective of the present invention to provide a printer in which the rotating print disc is stationarily mounted, and is not moved linearly, but wherein the record medium itself is transported continuously and linearly past the print disc.

In the Jerome printing mechanism (U.S. Pat. No. 2,071,406), the print disc is not spoked. However, the disc itself is quite thin and does not serve as a platen. Rather, a solenoid and yoke mechanism is used to press a platen and an abutment toward each other on opposite sides of the printing disc to accomplish printing. This arrangement is quite satisfactory for very slow speed operation, as when only a single number is being printed. However, the considerable mass of the platen and the abutment means that a relatively long time is required to move these into place to accomplish printing of a single character. Therefore the arrangement is totally unacceptable for high speed printing. Another object of the present invention is to provide a disc printer in which a separate platen is not required, and which is capable of relatively high speed printing.

SUMMARY OF THE INVENTION

These and other objectives are achieved by providing a disc printer which utilizes a relatively massive print disc having on its face two sets of raised type fonts, each arranged in a spiral. For use in check printer applications, the fonts of the inner spiral advantageously are configured to print machine readable characters. The fonts of the outer set may be aligned to facilitate printing in a vertical position above or below that in which the characters from the inner set are printed. In this manner, the same print disc can be used to accomplish printing at two different elevations without requiring vertical transport of the record medium.

The inner font set has a lower velocity (i.e., a shorter length of travel along the spiral per unit time) than does the outer type set. The present invention facilitates very high resolution printing by taking advantage of the relatively slow inner type font velocity, and by using relatively few characters (typically just the numerals zero through nine and a few other symbols) for the inner font set. In this manner, each font is presented for printing for a time duration that is sufficiently long to accomplish striking virtually free of smear. High resolution is achieved.

The print disc itself has sufficient mass to enable it to function as a platen. No other platen is used. Furthermore, since both type font sets are arranged on the face of the print disc, there is no need either to curl the check or other record medium around a cylindrical platen, or to move the check in the vertical direction. Only a simple check holding and horizontal transport mechanism is required.

BRIEF DESCRIPTION OF THE DRAWINGS

A detailed description of the invention will be made with reference to the accompanying drawings, which are not necessarily to scale.

FIG. 3A and 3B are diagrammatic views showing the inventive print disc at two different orientations during a printing operation.

FIGS. 4A and 4B are diagrammatic side and top views which illustrate printing of the upper indicia 14 on the check of FIG. 1.

FIGS. 4C and 4D are diagrammatic side and top views illustrating printing of the high resolution characters in the region 11 of the check of FIG. 1.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention best is defined by the appended claims.

Figure 2:
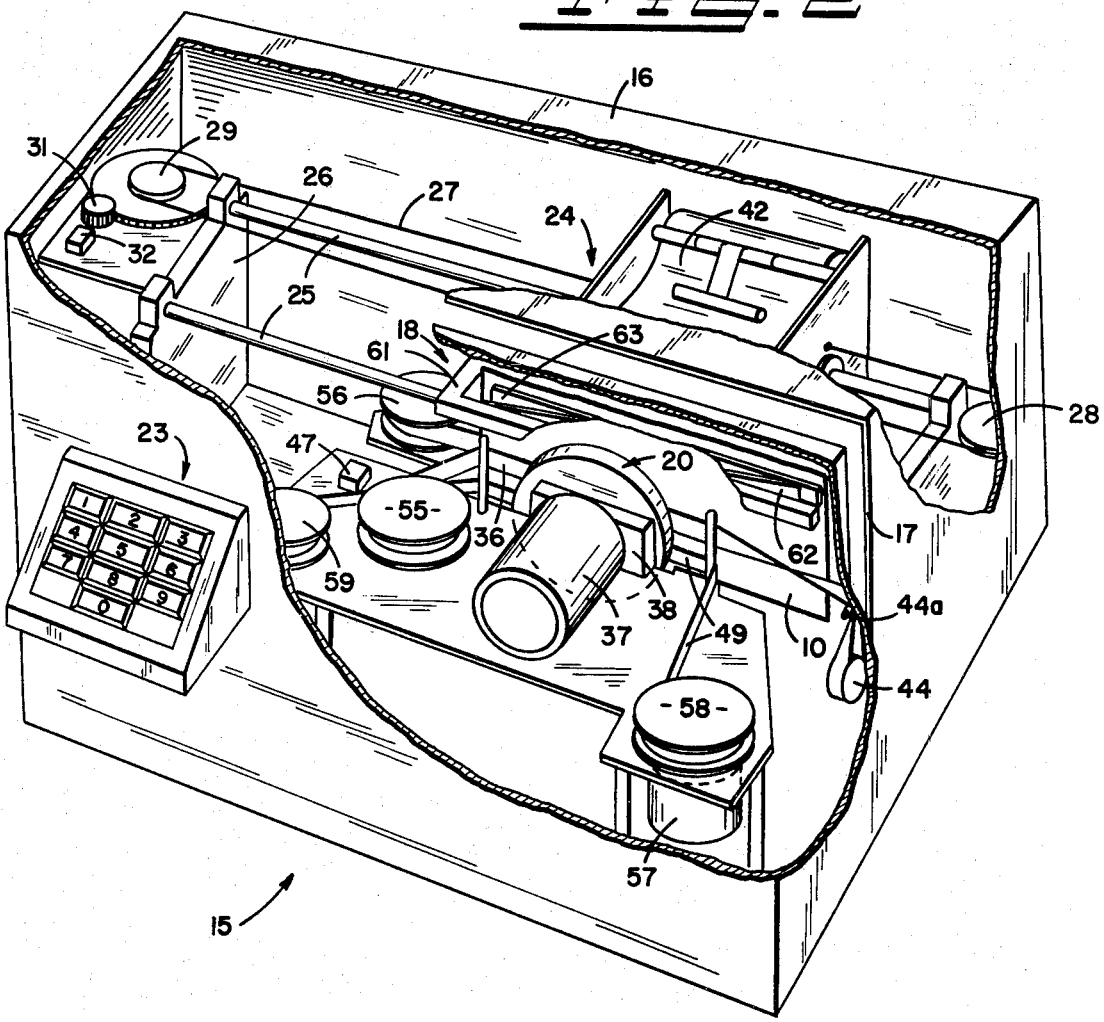
FIG. 2 is a front perspective view of a check printer in accordance with the present invention, and utilizing a solid print disc of the type shown in FIGS. 3A and 3B.
Figure 5:
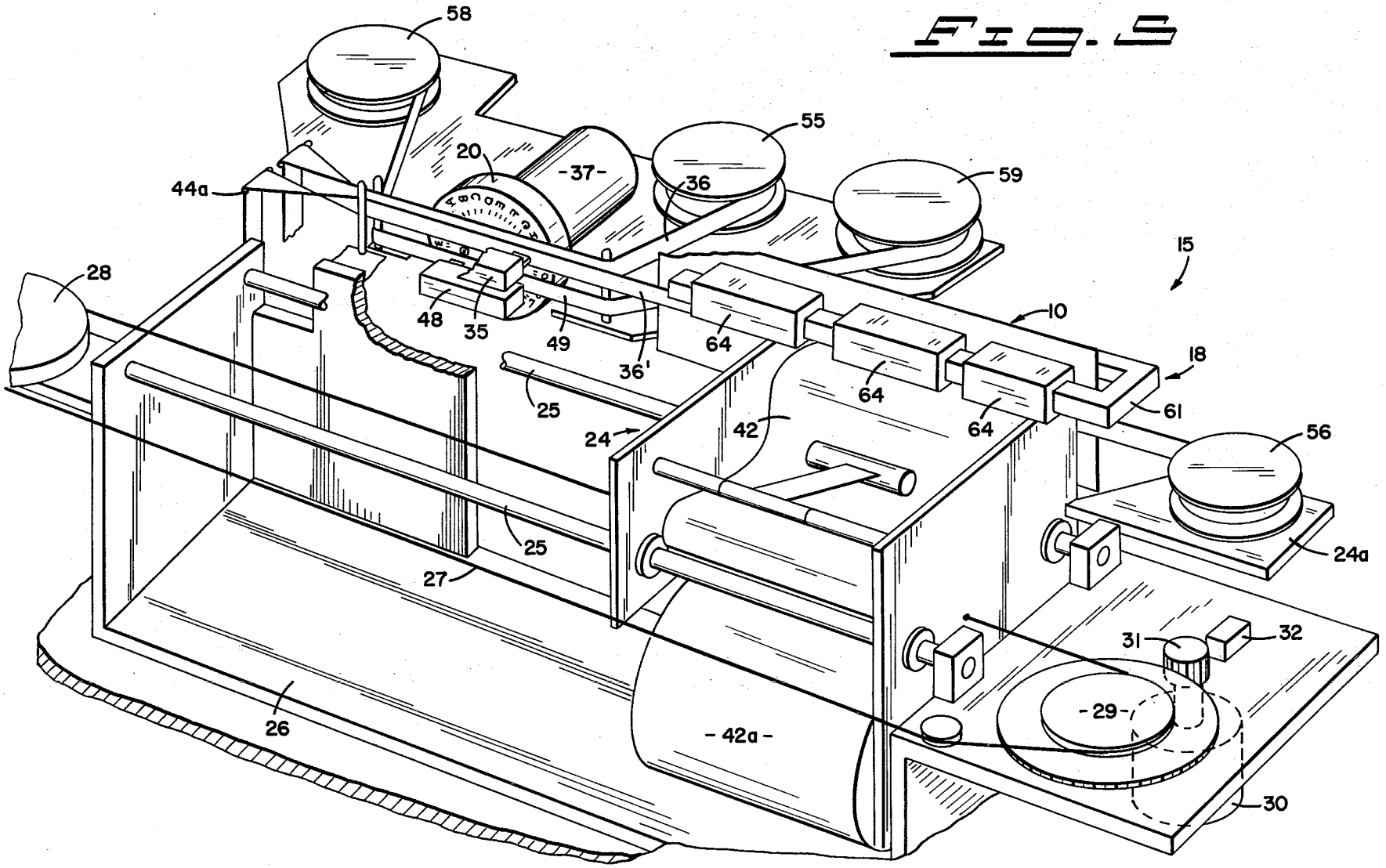
FIG. 5 is a rear perspective view of the check printer of FIG. 2.

Referring to FIGS. 2 and 5, the inventive check printer 15 is contained in a housing 16 having a slot 17 into which an operator inserts the check 10 to be printed. The upper edge of the check is grasped by a clamping mechanism 18 which holds the check 10 in an upright position facing a print disc 20. As described below in conjunction with FIGS. 3A through 4D, the print disc 20 contains two sets of type fonts 21 and 22 for respectively printing the numerals 11 and the indicia 14 onto the check 10. The print disc 20 also serves as a platen for the printing operation.

The dollar amount to be printed on the check is entered by the operator onto a keyboard 23. This amount may be read from the check region 13 (FIG. 1) the check 10 is inserted into the unit 15, or after it is inserted by viewing it through a window (not shown) in the housing 15. The dollar value so entered may be supplied to the bank's accounting computer (not shown) for amount verification, or may be used directly to control appropriate circuitry (not shown, but known per se) which is used to control the printing operation.

The clamping mechanism 18 is attached to a carriage 24 which moves horizontally along a pair of support rods 25 that are attached to a frame 26. After insertion of the check 10, the carriage 24 and the clamping mechanism 18 are transported to the left (as viewed in FIG. 2). To accomplish this, the carriage 24 is attached to a drive cable 27 which loops around an idler pulley 28 and a drive pulley 29 that is attached to a drive motor 30 via a pinion 31. The pinion 31 also cooperates with a detector 32 to provide pulses indicative of the motor 30 rotation rate. These pulses are used by circuitry (not shown, but known per se) to control the speed of the motor 30 so that the carriage 24 will transport the check 10 past the print disc 20 at a substantially uniform linear velocity.

During transport toward the left, the indicia 14 may be printed onto the check 10. To accomplish this, an upper print hammer 35 (FIGS. 4A and 5) impacts the check 10 and an upper ribbon 36 against the appropriate raised type font in the outer set 22 (FIG. 3A) on the face of the print disc 20. The disc 20 also functions as the platen for this printing operation.

The print disc 20 is rotated at a constant rate by a motor 37 which is affixed to the frame 26 by means of a support 38 which may act as a back-up block for the print disc 20. A set 39 (FIG. 3A) of raised index marks are situated near the periphery of the print disc 20. The passage of these index marks is detected by a sensor 40 (FIG. 4A) which provides signals to circuitry (not shown, by known per se) that ascertains which character currently is available for printing. The same circuitry energizes the hammer 35 at an appropriate time so as to impact the check 10 against the print disc 20 when the correct character is aligned at the upper print position 41 (FIG. 3A).

To provide a permanent written record of all transactions, the information which is printed in the location 14 of the check 10 simultaneously is printed onto a paper tape 42. The tape 42 is supplied from a spool **42*a* (FIGS. 4A and 5) that is held by the carriage 24. The tape 42 is guided by a set of rails 43 through the space between the upper hammer 35 and the rear of the check 10. The ribbon 36 is doubled back via a guide pulley 44 so as to pass between the rear of the check 10 and the front of the paper tape 42, as best shown at 36' in FIG. 4B. Thus when the print hammer 35 is actuated, it impacts the paper tape 42, the ribbon section 36', check 10 and the ribbon 36 against the print disc 20. Simultaneous printing of the indicia 14 on the front and back of the check 10 and on the paper tape 42** thus is accomplished.

Figure 1:
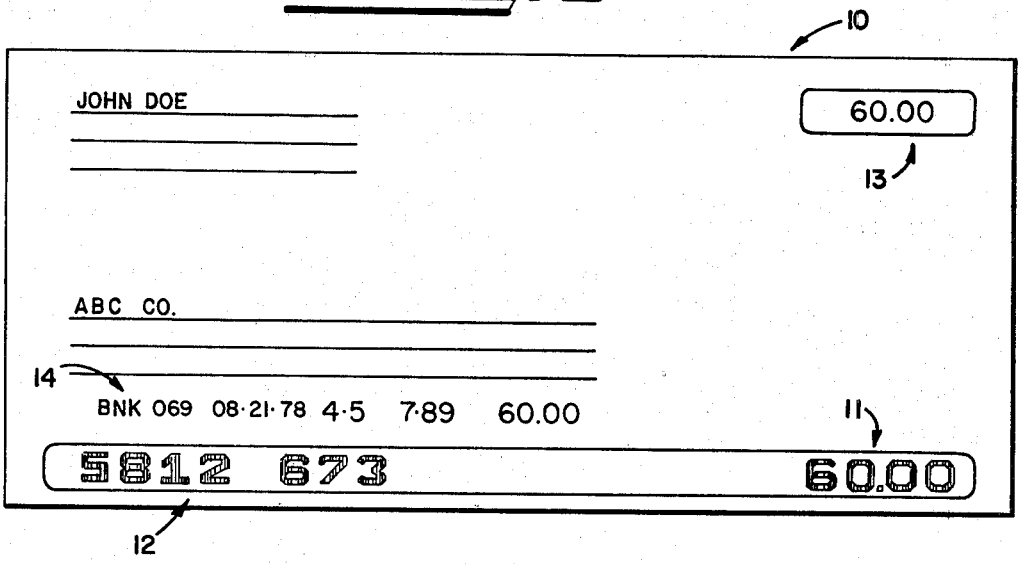
FIG. 1 shows a check imprinted using the apparatus of FIG. 2.

As the carriage 24 is moving to the left, the bank identification number and the drawer's checking account number are read from the region 12 of the check 10 by an appropriate sensor 47 (FIG. 1). This information may be fed to the bank's accounting computer along with the amount of the check that was entered via the keyboard 23. The computer then may verify that sufficient funds are present in the account to cover the check, and may send back appropriate print commands to direct printing of the amount into the region 11 of the check 10.

After the carriage 24 has reached its left-most position, the motor 30 is reversed and the carriage 24 is driven to the right as viewed in FIG. 2. Again, the signals developed by the sensor 32 are used to control the motor 30 so as to drive the carriage 24 and the check 10 past the print disc 20 at a substantially uniform linear velocity. It is during this movement to the right that the digits are printed in the zone 11.

To accomplish such printing, a second, lower hammer 48 (FIGS. 4C and 5) also is stationarily mounted to the frame 26 facing the print disc 20. A second ribbon 49, preferably of the non-cloth, magnetic ink type, is guided past the face of the print disc 20 between the lower hammer 48 and the print disc 20. When the correct type font in the set 21 is aligned for printing, the lower hammer 48 is actuated so as to impact the check 20 and the ribbon 49 against the print disc 20. Printing is accomplished again, with the print disc 20 acting as a platen. Finally, when the carriage 24 reaches its right-most position, the edge of the check 10 will project through the opening 17 for easy removal by the operator.

As an alternative mode of operation, only data reading by the sensor 47 is carried out during movement to the left, and printing of both the indicia 14 and the numerals 11 is done with the check moving to the right. Such dual printing in one direction of check motion is illustrated in FIGS. 3A and 3B. As described above, the type font sets 21 and 22 each have a spiral arrangement on the face of the print disc 20. In FIGS. 3A and 3B, the face of the disc 20 is viewed from the position of the hammers 35 and 48, with the check 10 shown in phantom and the ribbons 36 and 49 omitted. From this orientation, the print disc 20 is rotating counterclockwise, as indicated by the arrow 50. The check 10 is moving toward the left, as indicated by the arrow 51. FIGS. 3A and 3B show the check 10 and the print disc 20 at two consecutive orientations separated by a time interval equal to the rotation of the print disc 20 through about 260°.

In the orientation of FIG. 3A, the type font **21*a* for the numeral "9" is aligned with the hammer 48, as indicated by the broken outline 48*a*. Thus the numeral "9" is available to be printed in the print position 11*a* indicated by the solid outline in FIG. 3A. This print position 11*a* begins at a distance D from the leading edge 10*a* of the check 10. If the numeral "9" is to be printed, the hammer 48 would strike the check 10, in the impact zone 48*a* (FIG. 3A), against the type font 21*a***.

If instead the numeral "1" is to be printed in the print position **11*a*, hammer 48 actuation is delayed until the check 10 and the print disc 20 assume the orientation of FIG. 3B. As can be seen there, the print disc 20 has rotated through approximately 260° so that the type font 21*b* for the numeral "1" now is aligned in the hammer impact area 48*a*. The center of the type font 21*b* situated further to the left of the axis 20*a* of the print disc 20 than was the type font 21*a* in the orientation of FIG. 3A. However, the check 10 has moved to the left by a corresponding distance x, so that the type font 21*b* now is exactly aligned with the print location 11*a*. By impacting the hammer 48 at the instant shown in FIG. 3B, the numeral "1" will be printed in the position 11*a***.

It will be appreciated that the pitch or increasing radius of the type font spiral 21 is selected so that it equals the distance travelled by the check 10 during one revolution of the print disc 20. Of course, the spiral is arranged so that, for constant rotation of the disc 20 in a given direction, the radius of the spiral 21 will increase in the direction of motion of the check 10 during printing if the hammer impact zone (e.g., the zone **48*a*) is to the left of the disc axis 20*a*. The spiral radius will decrease in the direction of check motion if the impact zone (e.g., the zone 35*a*) is to the right of the disc axis 20*a*. The latter factor accounts for the opposite spiral arrangement of the outer type font set 22. Thus the type font spiral 22 has a radius which decreases with counterclockwise disc 20 rotation (FIGS. 3A and 3B) whereas the spiral 21** increases in radius with like rotation.

Another difference between the type font sets 21 and 22 is the character orientation. In the set 21, the fonts are arranged to be upright in a hammer impact area **48*a* which is aligned horizontally with the axis 20*a* of the print disc 20. In the set 22, the fonts are aligned to be upright in a hammer impact area 35*a* which is centered at a height h above the horizontal level of the print disc 20 axis. This arrangement enables the same print disc 20 to be used for printing at two different elevations. Since the face of the print disc 20 is flat, the same arrangement enables this dual elevation printing to take place without the need for translating the check vertically, and without the need for curving the check 10** around a platen.

The index marks 39 which are detected by the sensor 40 are shown in FIG. 3A. Although only a few of these index marks 39 are illustrated, such marks advantageously are present with uniform spacing around an entire circular path on the face of the print disc 20. One or two additional marks 39a may be provided to produce the sensor 40 a "home" signal that indicates when the disc 20 has reached a fixed reference position. It is from these index and home pulses that the appropriate hammer drive signals are derived for the hammers 35 and 48, to ensure printing of the desired characters.

To facilitate simultaneous printing of the check 10 and the record tape 42, the ribbon 36 (FIGS. 2, 4B and 5) advantageously is fed from a supply reel 55 mounted on the frame 26 to a take-up reel 56 which is mounted on a bracket 24a attached to the carriage 24. One inked surface 36a of the ribbon 36 faces the check 10, as indicated in FIG. 4B. The ribbon 36 is carried downward past a pair of pegs 44a and around an idler pulley 44 (FIG. 1) which is mounted to the frame 26 at a level below the bottom of the check 10. With this arrangement, a space is provided in alignment with the opening 17 between the ribbon section 36 in front of the check 10 and the ribbon portion 36' behind the check. This space, of course, allows easy insertion of the check 10.

Behind the check 10, one inked surface 36a' of the ribbon faces rearwardly toward the paper tape 42 to accomplish printing onto that medium. The other inked surface of the ribbon 36 faces the back of the check 10 to print the same information thereon. An appropriate drive mechanism (not shown, but known per se) is provided for the take-up spool 56. Similarly, a drive motor 57 is associated with a take-up reel 58 which receives the ribbon 49 from a source reel 59. Both of these reels 58 and 59 are mounted to the frame 26.

During the printing of the indicia 14, the carriage 24 and the paper tape 42 are situated generally as shown in FIGS. 2 and 4A. Although the paper tape 42 may be between the lower print hammer 48 and the print disc 20, this does not interfere with printing in the zone 11, since such printing does not occur with the carriage so oriented. Rather, printing of the numerals in the zone 11 takes place with the carriage generally situated so that the paper tape 42 no longer is interposed between the lower hammer 48 and the print disc 20. Thus the hammer 48 can directly impact the check 10, as shown in FIG. 4C.

Advantageously, the type fonts in the set 21 are of the machine readable variety. For example, these may be of the type where within each block numeral there is a set of vertical lines, the spacing and/or thickness of which constitute an optically readable code. Such characters are indicated generally in FIG. 1. However, the invention is by no means limited to this particular form of type font. Also, the fonts in the set 21 may be of different size and spacing than the set 22. For example, the set 21 may be CMC-type machine readable characters with a between center spacing for adjacent printed numerals of twice the spacing between adjacent letter printed with the set 22. In this case, the disc 20 is allowed to make a full revolution without printing between the printing of adjacent characters in the set 21. Adjacent characters in the set 22 are printed on consecutive revolutions.

The check clamping mechanism 18 advantageously includes a generally U-shaped frame 61 (FIGS. 2 and 5) which is supported by the carriage 24. A set of resilient leaf springs 62 gently bias a holding bar 63 toward the rear leg of the frame 61. Mounted on the leg 61 are a set of electromagnets 64. When the check 10 is inserted as shown in FIG. 2, these electromagnets 64 are energized, so as to attract toward them the bar 63. This firmly clamps the top edges of the check 10 between the bar 63 and the rear frame member 61. At the end of the printing operation the electromagnets 64 are turned off, thereby releasing the bar 63 and allowing the check 10 easily to be removed from the clamping mechanism 18.

By way of example only, the print disc 20 may have a diameter on the order of 7.5 cm, a thickness on the order of 1 cm and a weight in the range of from about 275 grams to about 450 grams, and may be made of 400 series magnetic stainless steel. The character fonts may be formed by etching directly onto the print disc. Alternatively, the character fonts may be etched onto a thin disc which then is laminated to a rigid flat disc to form an integral structure. Of course, the invention is not limited to these exemplary materials or dimensions.

The print disc 20 of FIG. 3A also can be used for printing in two directions, by reversing the direction of rotation of the disc 20 when the check 10 is moving to the right and the characters in the outer font set 22 are being printed. In this way, the "spiral" of the set 22 will increase in radius as the disc 20 rotates clockwise, so that the font set 22 will "track" the rightward movement of the check 10.

We claim:

1. A print disc for use in a printing apparatus, said print disc having a flat front face, said apparatus having a stationarily mounted hammer and a rotational mounting means for rotating said print disc at a substantially constant rate while maintaining said print disc at a stationary location with said flat front face opposite said hammer, and means for linearly moving a medium onto which characters are to be printed between said front face and said hammer, said print disc having at least one set of raised type fonts integrally formed on the flat front face thereof and arranged in a spiral, characterized in that said print disc is sufficiently rigid so as to enable said disc to sustain the impact of printing by said hammer without axial distortion or movement, whereby said print disc itself act as the platen for printing.

2. A print disc for use in a printing apparatus having a stationarily mounted hammer and a rotational mounting means for rotating said print disc at a substantially constant rate while maintaining said print disc at a stationary location with the front face of the print disc opposite said hammer, and means for linearly moving a medium onto which characters are to be printed between said front face and said hammer, said print disc having at least one set of raised type fonts integrally formed on the front face thereof and arranged in a spiral, characterized in that said print disc is sufficiently rigid so as to enable said disc to sustain the impact of printing by said hammer without axial distortion or movement, whereby said print disc itself acts as the platen for printing, whereby said print disc has a second set of raised type fonts integrally formed on the front face thereof and arranged in a spiral situated radially outward of said one set, the characters of said one set of fonts being arranged to be upright as they rotate past a first print hammer impact zone, the characters of said second set of fonts being arranged to be upright as they rotate past a second print hammer impact zone at an elevation different from said first impact zone, so that printing at two different elevations can be accomplished with the same print disc, and without elevational movement of said medium.

3. A print disc according to claim 2 wherein the spiral of said first set of fonts increases in radius and the spiral of said second set of fonts decreases in radius as said disc rotates in a certain direction, thereby facilitating printing onto said medium using said first set of fonts with a hammer impact zone on one side of the axis of the print disc and using said second set of fonts with a hammer impact zone on the other side of the print disc axis.

4. A print disc according to claim 2 and useful for printing onto bank checks, wherein said first set of fonts comprises machine readable characters.

5. A printing mechanism for printing onto a medium comprising:

a relatively massive, rigid print disc, a stationarily mounted motor means for rotating said print disc at a substantially constant rate, a set of raised type fonts integrally formed on the flat front surface of said disc and arranged in a spiral, a print hammer stationarily mounted facing said print disc, translation means for continuously moving said medium linearly past said print disc between said hammer and said disc at a linear velocity equal to the product of the rate of rotation of said disc and the pitch of said spiral, whereby printing is accomplished by actuating said hammer to strike said medium against said print disc when the desired font is facing said hammer, said disc itself acting as the platen for said printing.

6. A check printer for printing high resolution characters onto a check, comprising:

a frame, a relatively massive, rigid print disc having a first set of raised character fonts arranged in a spiral on the flat front face thereof, said disc being rotationally mounted to said frame at a stationary location with respect thereto, motor means for rotating said print disc at a substantially constant rotation rate, a first print hammer stationarily mounted to said frame facing said disc, a ribbon situated between said hammer and said disc, check transport means for holding said check and for transporting said check linearly and at a substantially constant rate past said print disc between said hammer and said character fonts, and means for actuating said hammer when a selected character font in said first set is aligned with said hammer, said hammer impacting said check and said ribbon against said disc to accomplish printing of said selected character, said print disc acting as the platen for said printing operation.

7. A check printer according to claim 6 wherein said print disc has a second set of raised character fonts arranged in a second spiral on the front face of the disc at a position radially outward of said first set of raised character fonts, and a second print hammer stationarily mounted to said frame and aligned to impact character fonts in said second set, and means for separately actuating said second hammer independently to print characters of said second set onto said check.

8. A check printer according to claim 7 wherein said second print hammer is mounted at a different elevation from said first print hammer, and wherein the character fonts of said second set are arranged so as to be upright when each character moves past the hammer impact zone at the elevation of said second hammer, and wherein said check is maintained in a flat plane during separate printing by both said first and second print hammers.

9. A check printer according to claim 7 further comprising a source of paper mounted on said transport means and arranged to pass between said second hammer and said check, so that characters printed on said check by impact of said second print hammer simultaneously are printed on said paper.

10. A check printer according to claim 9 further comprising:

a second ribbon, and means for guiding said ribbon twice between said second print hammer and said print disc and for orienting the ink face of said ribbon separately to face both said check and said paper.

11. A check printer according to claim 7 and adapted to print characters of said first set during check transport in one direction past said print disc and to print characters of said second set during check transport in the opposite direction, characterized in that each type font set is arranged to have a spiral radius which tracks the direction of check movement at the respective hammer impact zone during printing with that font set.

12. A check printer according to claim 11 intended for use with an accounting computer, said printer further comprising:

a character reader mounted on said frame in a position to read data from said check during transport of said check in one direction, and keyboard means for entering an amount to be printed on said check during motion in a second direction, said accounting computer being utilizable to verify from the data read from said check by said character reader that sufficient funds are available to cover the entered amount, and to enable printing of said entered amount during transport of said check in the other direction.

* * * * *